US007854591B2

(12) United States Patent
Liang

(10) Patent No.: US 7,854,591 B2
(45) Date of Patent: Dec. 21, 2010

(54) AIRFOIL FOR A TURBINE OF A GAS TURBINE ENGINE

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 865 days.

(21) Appl. No.: 11/800,786

(22) Filed: May 7, 2007

(65) Prior Publication Data

US 2008/0279696 A1 Nov. 13, 2008

(51) Int. Cl.
*F01D 5/08* (2006.01)

(52) U.S. Cl. ..... 416/97 R; 415/115

(58) Field of Classification Search ..... 415/115; 416/97 R

See application file for complete search history.

(56) References Cited

U.S. PATENT DOCUMENTS 5,403,159 A * 4/1995 Green et al. ..... 416/97 R
5,484,258 A 1/1996 Isburgh et al.
6,036,441 A * 3/2000 Manning et al. ..... 416/97 R
6,254,334 B1 7/2001 LaFleur
6,402,470 B1 6/2002 Kvasnak et al.
6,402,471 B1 * 6/2002 Demers et al. ..... 416/97 R
6,955,525 B2 10/2005 Liang
6,981,846 B2 1/2006 Liang
6,994,521 B2 * 2/2006 Liang ..... 416/97 R
2005/0095118 A1 5/2005 Liang
2005/0226726 A1 * 10/2005 Lee et al. ..... 416/97 R
2005/0265837 A1 12/2005 Liang
2005/0265838 A1 12/2005 Liang
2006/0002788 A1 1/2006 Liang

FOREIGN PATENT DOCUMENTS

EP 1584790 A2 10/2005
GB 2314126 A 12/1997
WO 9412766 A1 6/1994

* cited by examiner

*Primary Examiner*—Igor Kershteyn

(57) ABSTRACT

An airfoil for a turbine of a gas turbine engine is provided. The airfoil comprises a main body comprising a wall structure defining an inner cavity adapted to receive a cooling air. The wall structure includes a first diffusion region and at least one first metering opening extending from the inner cavity to the first diffusion region. The wall structure further comprises at least one cooling circuit comprising a second diffusion region and at least one second metering opening extending from the first diffusion region to the second diffusion region. The at least one cooling circuit may further comprise at least one third metering opening, at least one third diffusion region and a fourth diffusion region.

19 Claims, 4 Drawing Sheets

AIRFOIL FOR A TURBINE OF A GAS TURBINE ENGINE

This invention was made with U.S. Government support under Contract Number DE-FC26-05NT42644 awarded by the U.S. Department of Energy. The U.S. Government has certain rights to this invention.

FIELD OF THE INVENTION

The present invention relates to an airfoil for a turbine of a gas turbine engine and, more preferably, to an airfoil having an improved cooling system.

BACKGROUND OF THE INVENTION

A conventional combustible gas turbine engine includes a compressor, a combustor, and a turbine. The compressor compresses ambient air. The combustor combines the compressed air with a fuel and ignites the mixture creating combustion products defining a working gas. The working gas travels to the turbine. Within the turbine are a series of rows of stationary vanes and rotating blades. Each pair of rows of vanes and blades is called a stage. Typically, there are four stages in a turbine. The rotating blades are coupled to a shaft and disc assembly. As the working gas expands through the turbine, the working gas causes the blades, and therefore the shaft and disc assembly, to rotate.

Combustors often operate at high temperatures. Typical combustor configurations expose turbine vanes and blades to these high temperatures. As a result, turbine vanes and blades must be made of materials capable of withstanding such high temperatures. In addition, turbine vanes and blades often contain internal cooling systems for prolonging the life of the vanes and blades and reducing the likelihood of failure as a result of excessive temperatures.

Typically, turbine vanes comprise inner and outer endwalls and an airfoil that extends between the inner and outer endwalls. The airfoil is ordinarily composed of a leading edge and a trailing edge. The vane cooling system receives air from the compressor of the turbine engine and passes the air through the airfoil. One example of a cooling system within a vane is disclosed in U.S. Pat. No. 6,254,334. The cooling system comprises a plurality of cooling circuits 26 incorporated within a wall of an airfoil to effect cooling of the airfoil wall.

Conventional turbine vanes have many different designs of internal cooling systems. While many of these conventional systems have operated successfully, the cooling demands of turbine engines produced today have increased. Thus, an internal cooling system for turbine vanes as well as blades having increased cooling capabilities is desired.

SUMMARY OF THE INVENTION

In accordance with a first aspect of the present invention, an airfoil for a turbine of a gas turbine engine is provided. The airfoil comprises a main body comprising a wall structure defining an inner cavity adapted to receive a cooling air. The wall structure includes a first diffusion region and at least one first metering opening extending from the inner cavity to the first diffusion region. The wall structure further comprises at least one cooling circuit comprising a second diffusion region and at least one second metering opening extending from the first diffusion region to the second diffusion region. The at least one second metering opening includes a length in a flow direction and first and second dimensions transverse to one another and to the length such that a first ratio of the length to the first dimension is equal to or greater than about 1.5:1 and a second ratio of the length to the second dimension is equal to or greater than about 1.5:1.

The first and second dimensions of the at least one second metering opening may be defined by a diameter of the at least one second metering opening.

The at least one cooling circuit may further comprise at least one third metering opening and at least one third diffusion region. The at least one third metering opening may extend from the second diffusion region to the at least one third diffusion region.

The at least one third metering opening may have a length in a flow direction and first and second dimensions transverse to one another and to the length such that a first ratio of the length of the at least one third metering opening to the first dimension of the at least one third metering opening is equal to or greater than about 1.5:1 and a second ratio of the length of the at least one third metering opening to the second dimension of the at least one third metering opening is equal to or greater than about 1.5:1.

The at least one third diffusion region may comprise a plurality of third diffusion regions. The at least one third metering opening may comprise a plurality of third metering openings. Each of the plurality of third metering openings preferably extends from the second diffusion region to a corresponding one of the plurality of third diffusion regions.

The wall structure may comprise inner and outer wall sections, first, second and third intermediate wall sections extending between the inner and outer wall sections, and a plurality of ribs extending between the inner and outer wall sections. The plurality of third metering openings and the plurality of third diffusion regions may be defined by corresponding portions of the inner and outer wall sections, corresponding portions of the first and third intermediate wall sections and the plurality of ribs.

The at least one second metering opening may comprise a plurality of second metering openings. Each of the plurality of ribs may be substantially in-line with a corresponding one of the second metering openings such that cooling air exiting each of the plurality of second metering openings impinges upon a corresponding one of the ribs.

The second diffusion region may be defined by corresponding portions of the inner and outer wall sections and corresponding portions of the first, second and third intermediate wall sections. A summation of a volume of each of the plurality of second metering openings may define a second metering opening summation volume. A ratio of a volume of the second diffusion region relative to the second metering opening summation volume may be greater than about 20:1.

The cooling circuit may further comprise a fourth diffusion region communicating with each of the plurality of third diffusion regions and terminating at an exit opening defined by curvilinear wall portions of the wall structure. The exit opening may have an area equal to or greater than about 10 times an area of one of the third metering openings.

The at least one cooling circuit may be located in a trailing edge of the main body such that a longitudinal axis of the at least one first metering opening is generally parallel with a longitudinal axis of the at least one second metering opening.

In accordance with a second aspect of the present invention, a vane is provided for a turbine of a gas turbine engine comprising first and second endwalls and an airfoil comprising a main body located between the first and second endwalls. The main body includes a wall structure having a first end adjacent the first endwall and a second end adjacent the second endwall. The wall structure may define an inner cavity adapted to receive a cooling air. The wall structure may further comprise a first diffusion region extending from the first end of the wall structure to the second end of the wall structure and at least one first metering opening extending from the inner cavity to the first diffusion region. The wall structure may further comprising first and second cooling circuits. Each of the first and second cooling circuits may comprise a second diffusion region and at least one second metering opening extending from the first diffusion region to the second diffusion region.

The at least one second metering opening in each of the first and second cooling circuits may include a length in a flow direction and first and second dimensions transverse to one another and to the length such that a first ratio of the length to the first dimension is equal to or greater than about 1.5:1 and a second ratio of the length to the second dimension is equal to or greater than about 1.5:1.

Each of the first and second cooling circuits further comprises at least one third metering opening and at least one third diffusion region. The at least one third diffusion region in each of the first and second cooling circuits may comprise a plurality of third diffusion regions. The at least one third metering opening in each of the first and second cooling circuits may comprise a plurality of third metering openings. Each of the third metering openings of the first cooling circuit may extend from the second diffusion region of the first cooling circuit to a corresponding one of the third diffusion regions of the first cooling circuit. Each of the third metering openings of the second cooling circuit may extend from the second diffusion region of the second cooling circuit to a corresponding one of the third diffusion regions of the second cooling circuit.

The wall structure may comprise first, second and third intermediate wall sections, a plurality of first ribs, and inner and outer wall sections. The plurality of third diffusion regions of the first cooling circuit may be defined by corresponding portions of the inner and outer wall sections, corresponding portions of the first and third intermediate wall sections and the plurality of first ribs.

The at least one second metering opening in the first cooling circuit may comprise a plurality of second metering openings. Each of the plurality of first ribs in the first cooling circuit may be substantially in-line with a corresponding one of the second metering openings in the first cooling circuit such that cooling air exiting each of the plurality of second metering openings in the first cooling circuit impinges upon a corresponding one of the first ribs in the first cooling circuit.

The first cooling circuit may further comprise a fourth diffusion region communicating with each of the plurality of third diffusion regions of the first cooling circuit and a first exit opening defined by corresponding curvilinear wall portions of the wall structure. The second cooling circuit may further comprise a fourth diffusion region communicating with each of the plurality of third diffusion regions of the second cooling circuit and a second exit opening defined by corresponding curvilinear wall portions of the wall structure.

The first cooling circuit may be located in a trailing edge of the main body such that a longitudinal axis of the at least one first metering opening is generally parallel with a longitudinal axis of the at least one second metering opening of the first cooling circuit.

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
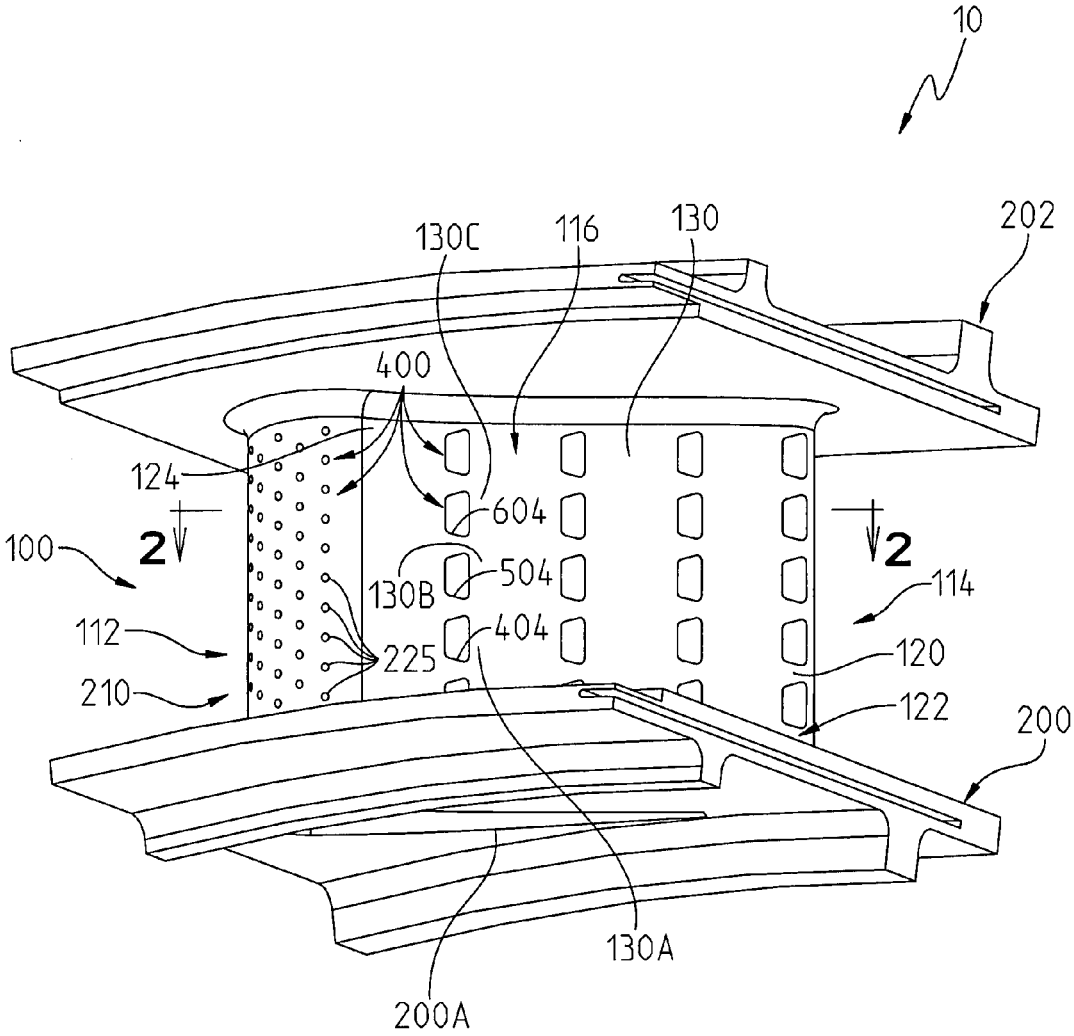
FIG. 1 is a perspective view of a vane including a cooling system constructed in accordance with the present invention.

Referring now to FIG. 1, a vane 10 constructed in accordance with a first embodiment of the present invention is illustrated. The vane 10 is adapted to be used in a gas turbine (not shown) of a gas turbine engine (not shown). The gas turbine engine includes a compressor (not shown), a combustor (not shown), and a turbine (not shown). The compressor compresses ambient air. The combustor combines compressed air with a fuel and ignites the mixture creating combustion products defining a high temperature working gas. The high temperature working gas travels to the turbine. Within the turbine are a series of rows of stationary vanes and rotating blades. Each pair of rows of vanes and blades is called a stage. Typically, there are four stages in a turbine. It is contemplated that the vane 10 illustrated in FIG. 1 may define the vane configuration for a first row of vanes in the gas turbine.

The stationary vanes and rotating blades are exposed to the high temperature working gas. To cool the vanes and blades, cooling air from the compressor is provided to the vanes and the blades.

The vane 10 is defined by an airfoil 100 and first and second endwalls 200 and 202, see FIG. 1. The airfoil 100 comprises a leading edge 112, a trailing edge 114, a concave-shaped pressure side 116, and a convex-shaped suction side 118. The airfoil 100 is defined by a main body 120 comprises a first end 122 adjacent the first endwall 200 and a second end 124 adjacent the second endwall 202. The main body 120 comprises a wall structure 210. The airfoil main body 120 and the first and second endwalls 200 and 202 may be formed as a single integral unit from a material such as a metal alloy 247 via a conventional casting operation. A conventional thermal barrier coating (not shown) is provided on an outer, surface 130 of the main body 120.

In accordance with the present invention, the airfoil main body 120 is provided with a cooling system 400 for effecting cooling of the airfoil 100. The cooling system 400 is incorporated into the main body wall structure 210. While the description below is directed to a cooling system in the airfoil main body of the vane 10, it is contemplated that the cooling system 400 of the present invention can be incorporated within an airfoil main body of a blade.

Figure 2:
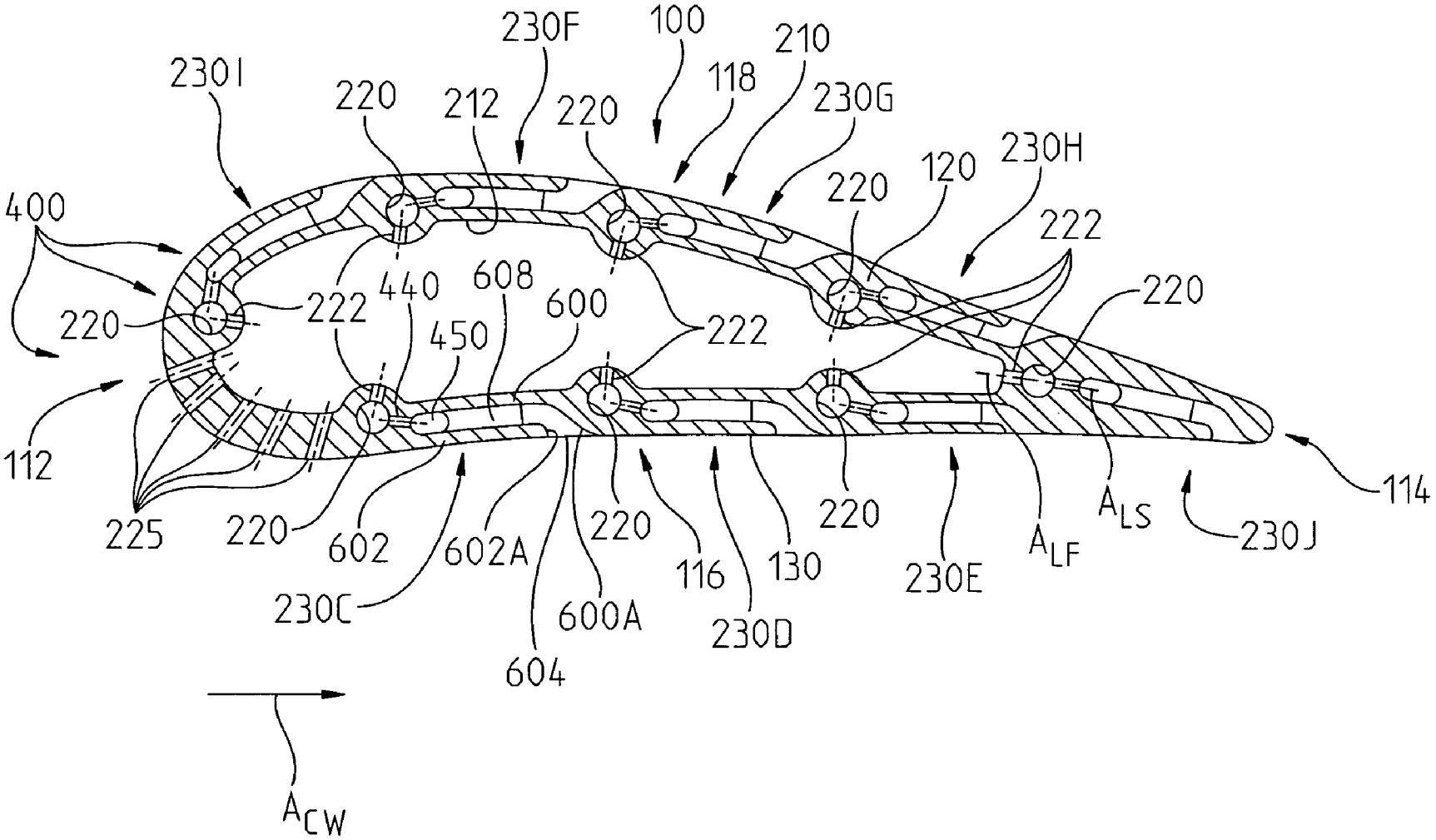
FIG. 2 is a view taken along view line 2-2 in FIG. 1.

The wall structure 210 defines an inner cavity 212, see FIG. 2. The inner cavity 212 is adapted to receive cooling air from the compressor, which cooling air may pass into the inner cavity 212 through an opening 200A in the first endwall 200, see FIG. 1.

Incorporated into the wall structure 210 are a plurality of first diffusion regions 220 and first metering openings 222, see FIG. 2. The first diffusion regions 220 and the first metering openings 222 define part of the cooling system 400. The first diffusion regions 220 are formed in the main body 120 so as to extend from the first end 122 of the main body 120 to a second end 124 of the main body 120. Because the first diffusion regions 220 extend from the main body first end 122 to the main body second end 124, the first diffusion regions 220 are easily formed in the main body 120 during casting of the vane 10. After casting, the first diffusion regions 220 are closed via plates (not shown) coupled to the first and second endwalls 200 and 202. The plate attached to the second endwall 202 also closes the inner cavity 212 at or near the second end 124 of the main body 120.

Figure 3:
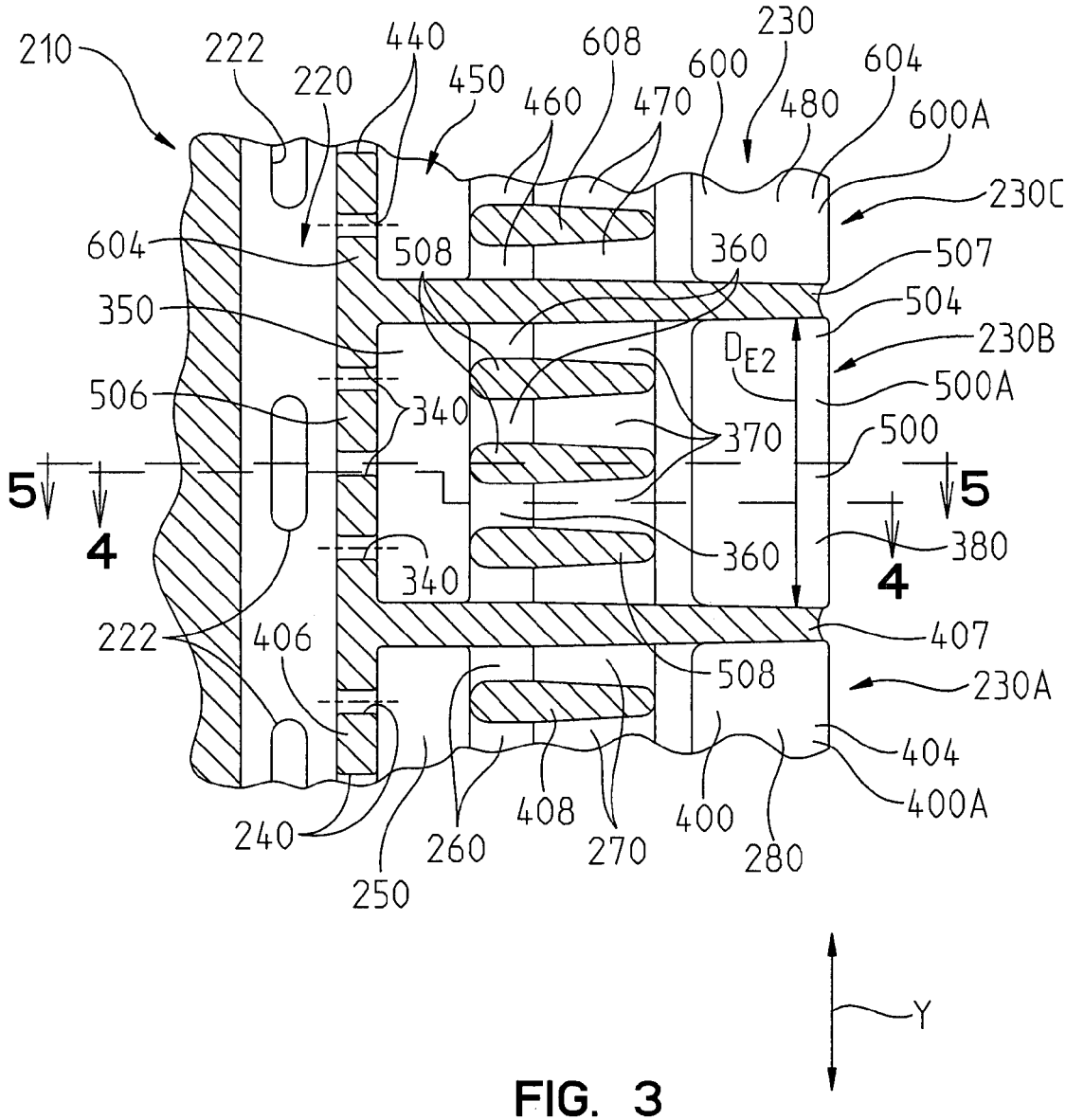
FIG. 3 is a sectional view of a portion of a wall structure of an airfoil main body of the vane in FIG. 1, with outer wall sections of first, second and third cooling circuits removed.

Preferably, a plurality of first metering openings 222 extend from the inner cavity 212 to each first diffusion region 220, see FIG. 3. The first openings 222 provide paths for cooling air to travel at a high velocity from the inner cavity 212 into the first diffusion regions 220. After passing through a first opening 222, cooling air moves towards a corresponding portion 210A of the wall structure 210, see arrow $A_{220}$ in FIGS. 4 and 5, so as to impinge upon the corresponding portion 210A, wherein the corresponding portion 210A is positioned opposite the first opening 222 and defines a portion of the corresponding first diffusion region 220. Hence, the cooling air impinges upon and effects cooling of the wall structure portion 210A. After the cooling air passes through the first openings 222 and impinges upon corresponding wall structure portions 210A, the cooling air diffuses within the first diffusion regions 220 prior to passing through second metering openings, to be discussed below. The pressure of the cooling air within the first diffusion regions 220 is less than the pressure of the cooling air within the inner cavity 212. The first metering openings 222 are illustrated in FIG. 3 having an oval shape. However, the first openings 222 may have a circular or other shape.

The wall structure 210 further comprises a plurality of bores 225 extending completely through the wall structure 210 and located at the leading edge 112 of the airfoil 100, see FIGS. 1 and 2. Cooling air passes from the inner cavity 212 through the bores 225. The bores 225 define part of the cooling system 400.

Further incorporated into the wall structure 210 are a plurality of cooling circuits 230. The cooling circuits 230 receive cooling air under pressure from a corresponding first diffusion region 220 so as to effect cooling of corresponding portions of the wall structure 210, see FIGS. 2-5. The cooling circuits 230 also define part of the cooling system 400.

The cooling circuits 230 may be aligned in columns extending between the first and second endwalls 200 and 202 of the vane 10. The cooling circuits 230 may also be aligned in rows extending along the pressure and suction sides 116 and 118 between the leading and trailing edges 112 and 114 of the airfoil 100. In FIG. 3, first, second and third cooling circuits 230A-230C are shown aligned in a column, such that the column extends between the first and second endwalls 200 and 202 of the vane 10. In FIG. 2, cooling circuits 230C-230E are aligned in a row on the pressure side 116 and cooling circuits 230F-230H are aligned in a row on the suction side 118. Also, as illustrated in FIG. 2, one or more cooling circuits 2301 are provided in the leading edge 112 and one or more cooling circuits 230J are provided in the trailing edge 114. Instead of being aligned in columns and rows, it is contemplated that the cooling circuits 230 may be offset or staggered relative to one another. Further, the number of cooling circuits 230 provided on the suction side 116 may vary from the number of circuits 230 provided on the pressure side 118. It is also contemplated that the number of cooling circuits 230 provided in the leading edge 112 may vary from the number of circuits 230 provided in the trailing edge 114. Thus, the number and arrangement of the cooling circuits 230 within the wall structure 210 may vary based on the cooling requirements of the leading edge 112, trailing edge 114, pressure side 116, and suction side 118 of the airfoil 100.

A description of the first, second and third cooling circuits 230A-230C will be described in detail herein. The remaining cooling circuits 230D-230J provided in the wall structure 210 may be formed having similar elements as the cooling circuits 230A-230C. However, the number, shape and size of those elements may vary for a given cooling circuit 230 based on the cooling requirements of the corresponding portion of the wall structure 210 containing that given cooling circuit 230.

The first cooling circuit 230A comprises a plurality of second metering openings 240 (only two of which are illustrated in FIG. 3), a second diffusion region 250, a plurality of third metering openings 260 (only two of which are illustrated in FIG. 3), a plurality of third diffusion regions 270 (only two of which are illustrated in FIG. 3), and a fourth diffusion region 280. The second metering openings 240 communicate with the first diffusion region 220 and the second diffusion region 250 and allow cooling air to pass at a high velocity from the first diffusion region 220 into the second diffusion region 250. The third metering openings 260 extend from the second diffusion region 250 to a corresponding one of the third diffusion regions 270 and allow cooling air to pass at a high velocity from the second diffusion region 250 into the third diffusion regions 270. The third diffusion regions 270 communicate with the fourth diffusion region 280 such that the air passes from the third diffusion regions 270 into the fourth diffusion region 280. The pressure of the cooling air within the fourth diffusion region 280 is less than the pressure of the cooling air within each third diffusion region 270. The pressure of the cooling air within each third diffusion region 270 is less than the pressure of the cooling air within the second diffusion region 250. Further, the pressure of the cooling air within the second diffusion region 250 is less than the pressure of the cooling air within the corresponding first diffusion region 220.

The second cooling circuit 230B comprises a plurality of second metering openings 340 (three in the illustrated embodiment), a second diffusion region 350, a plurality of third metering openings 360 (three in the illustrated embodiment), a plurality of third diffusion regions 370 (three in illustrated embodiment), and a fourth diffusion region 380. The second metering openings 340 communicate with the first diffusion region 220 and the second diffusion region 350 of the second cooling circuit 230B and allow cooling air to pass at a high velocity from the first diffusion region 220 into the second diffusion region 350. The third metering openings 360 extend from the second diffusion region 350 to a corresponding one of the third diffusion regions 370 and allow cooling air to pass at a high velocity from the second diffusion region 350 into the third diffusion regions 370. The third diffusion regions 370 communicate with the fourth diffusion region 380 such that the air passes from, the third diffusion regions 370 into the fourth diffusion region 380. The pressure of the cooling air within the fourth diffusion region 380 is less than the pressure of the cooling air within each third diffusion region 370. The pressure of the cooling air within each third diffusion region 370 is less than the pressure of the cooling air within the second diffusion region 350. Further, the pressure of the cooling air within the second diffusion region 350 is less than the pressure of the cooling air within the corresponding first diffusion region 220.

The third cooling circuit 230C comprises a plurality of second metering openings 440 (only two of which are illustrated in FIG. 3), a second diffusion region 450, a plurality of third metering openings 460 (only two of which are illustrated in FIG. 3), a plurality of third diffusion regions 470 (only two of which are illustrated in FIG. 3), and a fourth diffusion region 480. The second metering openings 440; communicate with the first diffusion region 220 and the second diffusion region 450 of the third cooling circuit 230C and allow cooling air to pass at a high velocity from the first diffusion region 220 into the second diffusion region 450. The third metering openings 460 extend from the second diffusion region 450 to a corresponding one of the third diffusion regions 470 and allow cooling air to pass at a high velocity from the second diffusion region 450 into the third diffusion regions 470. The third diffusion regions 470 communicate with the fourth diffusion region 480 such that the air passes from the third diffusion regions 470 into the fourth diffusion region 480. The pressure of the cooling air within the fourth diffusion region 480 is less than the pressure of the cooling air within each third diffusion region 470. The pressure of the cooling air within each third diffusion region 470 is less than the pressure of the cooling air within the second diffusion region 450. Further, the pressure of the cooling air within the second diffusion region 450 is less than the pressure of the cooling air within the corresponding first diffusion region 220.

It is noted that the second metering openings 240, 340, 440 of each of the first, second and third cooling circuits 230A-230C communicate with the same first diffusion region 220, see FIG. 3.

The first cooling circuit 230A is defined within the wall structure 210 by corresponding inner and outer wall sections (only the inner wall section 400 is illustrated in FIG. 3), first, second and third intermediate wall sections (only the second and third intermediate wall sections 406 and 407 are illustrated in FIG. 3), extending between the inner and outer wall sections, and a plurality of first ribs 408 (only a single rib 408 is illustrated in FIG. 3), extending between the inner and outer wall sections, see FIG. 3. The second metering openings 240 of the first cooling circuit 230A are formed in the second intermediate wall section 406. The second diffusion region 250 is defined by corresponding portions of the inner and outer wall sections (only the inner wall section 400 is illustrated in FIG. 3) and corresponding portions of the first, second and third intermediate wall sections (only the second and third intermediate wall sections 406 and 407 are illustrated in FIG. 3). The third metering openings 260 and the third diffusion regions 270 of the first cooling circuit 230A are defined by corresponding portions of the inner and outer wall sections (only the inner wall section 400 is illustrated in FIG. 3), corresponding portions of the first and third intermediate wall sections (only the third intermediate wall section 407 is illustrated in FIG. 3) and the first ribs 408. Each of the first ribs 408 is preferably in-line with a corresponding one of the second metering openings 240 of the first cooling circuit 230A such that cooling air exiting each of the plurality of second metering openings 240 impinges upon a corresponding one of the first ribs 408 to enhance cooling of the first ribs 408.

Curvilinear portions of the inner and outer wall sections (only curvilinear wall portion 400A of the inner wall section 400 is illustrated in FIG. 3) and corresponding portions of the first and third intermediate wall sections (only the third intermediate wall sections 407 is illustrated in FIG. 3) of the first cooling circuit 230A define the fourth diffusion region 280 and terminate at an exit opening 404 through which cooling air leaves the fourth diffusion region 280 of the first cooling circuit 230A, see FIGS. 1 and 3. Due to the shape of the curvilinear portions of the inner and outer wall sections, the cooling air leaving the exit opening 404 is believed to form a film of cooling air along a corresponding downstream portion 130A of the outer surface 130 of the main body 120 so as to protect the downstream portion 130A from the high temperature working gases moving along the airfoil 100, see FIG. 1. The exit opening 404 may have an area equal to or greater than about 10 times an area of one of its corresponding third metering openings 260. Due to the large size of the exit opening 404, it is unlikely that the material applied to the outer surface 130 of the main body 120 to form the thermal barrier coating (not shown) will extend across or block the exit opening 404.

Figure 4:
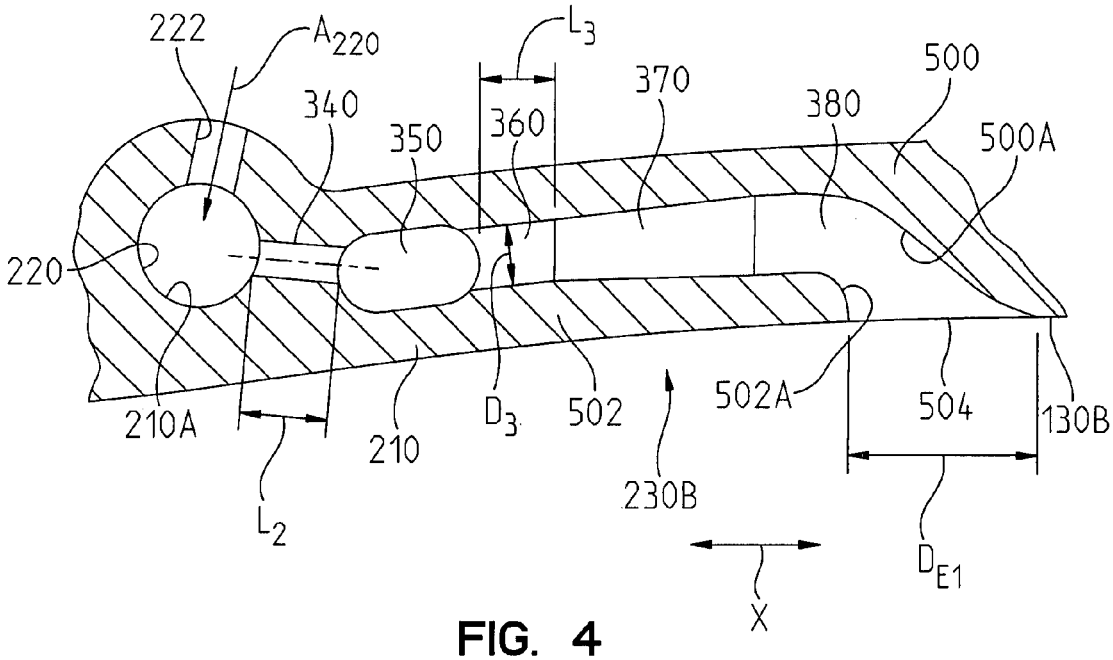
FIG. 4 is a view taken along view line 4-4 in FIG. 3.
Figure 5:
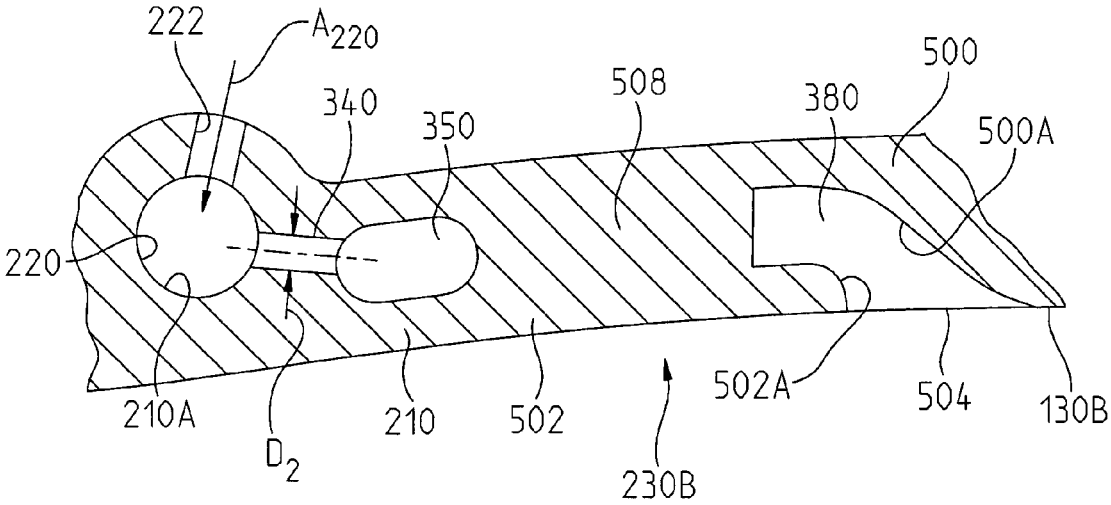
FIG. 5 is a view taken along view line 5-5 in FIG. 3.

The second cooling circuit 230B is defined within the wall structure 210 by corresponding inner and outer wall sections 500 and 502, first, second and third intermediate wall sections 407, 506, 507 extending between the inner and outer wall sections, and a plurality of first ribs 508 extending between the inner and outer wall sections, see FIGS. 3-5. The first intermediate wall section 407 for the second cooling circuit 230B is the same wall as the third intermediate wall section 407 for the first cooling circuit 230A. The second metering openings 340 of the second cooling circuit 230B are formed in the second intermediate wall section 506. The second diffusion region 350 is defined by corresponding portions of the inner and outer wall sections 500, 502 and corresponding portions of the first, second and third intermediate wall sections 407, 506 and 507. The third metering openings 360 and the third diffusion regions 370 of the second cooling circuit 230B are defined by corresponding portions of the inner and outer wall sections 500 and 502, corresponding portions of the first and third intermediate wall sections 407, 507 and the second ribs 508. Each of the second ribs 508 is preferably in-line with a corresponding one of the second metering openings 340 of the second cooling circuit 230B such that cooling air exiting each of the plurality of second metering openings 340 impinges upon a corresponding one of the second ribs 508 to enhance cooling of the second ribs 508.

Curvilinear portions 500A and 502A of the inner and outer wall sections 500 and 502 and corresponding portions of the first and third intermediate wall sections 407, 507 of the second cooling circuit 230B define the fourth diffusion region 380 and terminate at an exit opening 504 through which cooling air leaves the second cooling circuit 230B, see FIGS. 1 and 3-5. Due to the shape of the curvilinear portions 500A and 502A of the inner and outer wall sections 500 and 502, the cooling air leaving the exit opening 504 is believed to form a film of cooling air along a corresponding downstream portion 130B of the outer surface 130 of the main body 120 so as to protect the downstream portion 130B from the high temperature working gases moving along the airfoil 100, see FIGS. 1, 4 and 5. The exit opening 504 may have an area defined by a first dimension $D_{E1}$ in an X-direction, see FIG. 4, and a second dimension $D_{E2}$ in a Y-direction. The area of the exit opening 504 is preferably equal to or greater than about 10 times an area of one of its corresponding third metering openings 360, see FIG. 4. Due to the large size of the exit opening 504, it is unlikely that the material applied to the outer surface 130 of the main body 120 to form the thermal barrier coating (not shown) will block the exit opening 504.

The third cooling circuit 230C is defined within the wall structure 210 by corresponding inner and outer wall sections 600 and 602, first, second and third intermediate wall sections (only the first and second intermediate wall sections 507 and 604 are illustrated in FIG. 3) extending between the inner and outer wall sections 600 and 602, and a plurality of third ribs 608 (only a single rib 608 is illustrated in FIG. 3) extending between the inner and outer wall sections 600 and 602, see FIGS. 2 and 3. The first intermediate wall section 507 for the third cooling circuit 230C is the same wall as the third intermediate wall section 507 for the second cooling circuit 230B. The second metering openings 440 of the third cooling circuit 230C are formed in the second intermediate wall section 604. The second diffusion region 450 is defined by corresponding portions of the inner and outer wall sections 600, 602 and corresponding portions of the first, second and third intermediate wall sections (only the first and second intermediate wall sections 507 and 604 are illustrated in FIG. 3). The third metering openings 460 and the third diffusion regions 470 of the third cooling circuit 230C are defined by corresponding portions of the inner and outer wall sections 600 and 602, corresponding portions of the first and third intermediate wall sections (only the first intermediate wall section 507 is illustrated in FIG. 3) and the third ribs 608. Each of the third ribs 608 is preferably in-line with a corresponding one of the second metering openings 440 of the third cooling circuit 230C such that cooling air exiting each of the plurality of second metering openings 440 impinges upon a corresponding one of the third ribs 608 to enhance cooling of the third ribs 608.

Curvilinear portions 600A and 602A of the inner and outer wall sections 600 and 602 and corresponding portions of the first and third intermediate wall sections (only the first intermediate wall section 507 is illustrated in FIG. 3) of the third cooling circuit 230C define the fourth diffusion region 480 and terminate at an exit opening 604 through which cooling air leaves the third cooling circuit 230C, see FIGS. 1-3. Due to the shape of the curvilinear portions 600A and 602A of the inner and outer wall sections 600 and 602, the cooling air leaving the exit opening 604 is believed to form a film of cooling air along a corresponding downstream portion 130C of the outer surface 130 of the main body 120 so as to protect the downstream portion 130C from the high temperature working gases moving along the airfoil 100. The exit opening 604 may have an area equal to or greater than about 10 times an area of one of its corresponding third metering openings 460. Due to the large size of the exit opening 604, it is unlikely that the material applied to the outer surface 130 of the main body 120 to form the thermal barrier coating (not shown) will block or close the exit opening 604.

In the illustrated embodiment, the second metering openings 240, 340 and 440 in the first, second and third cooling circuits 230A-230C as well as the second metering openings in the remaining cooling circuits 230D-230J preferably have a length $L_2$ in a flow direction and first and second dimensions $D_2$ transverse to one another and to the length $L_2$ such that a first ratio of the length $L_2$ to the first dimension $D_2$ is equal to or greater than about 1.5:1 and a second ratio of the length $L_2$ to the second dimension $D_2$ is equal to or greater than about 1.5:1, see FIGS. 4 and 5. In the illustrated embodiment, the second metering openings 240, 340 and 440 are generally cylindrical in shape. Hence, the first and second dimensions $D_2$ are equal to the diameter of the second metering openings 240, 340 and 440. Thus, the first and second dimensions of the second metering openings are equal to one another.

It is also preferred that the third metering openings 260, 360 and 460 in the first, second and third cooling circuits 230A-230C as well as the third metering openings in the remaining cooling circuits 230D-230J have a length $L_3$ in a flow direction and first and second dimensions $D_3$ transverse to one another and to the length $L_3$ such that a first ratio of the length $L_3$ to the first dimension $D_3$ is equal to or greater than about 1.5:1 and a second ratio of the length $L_3$ to the second dimension $D_3$ is equal to or greater than about 1.5:1, see FIG. 4. In the illustrated embodiment, the third metering openings 260, 360 and 460 are generally cylindrical in shape. Hence, the first and second dimensions $D_3$ of the third metering openings are equal to the diameter of the third metering openings 260, 360 and 460. Thus, the first and second dimensions of the third metering openings are equal to one another.

The third diffusion regions 270, 370 and 470 in the first, second and third cooling circuits 230A-230C as well as the third diffusion regions in the remaining cooling circuits 230D-230J preferably diverge away or increase in size from their corresponding third metering openings 260, 360 and 460.

A summation of a volume of each of the plurality of the second metering openings 240 in the first cooling circuit 230A defines a second metering opening summation volume for the first cooling circuit 230A. A ratio of a volume of the second diffusion region 250 for the first cooling circuit 230A relative to the second metering opening summation volume for the first cooling circuit 230A is preferably greater than about 20:1. A second metering opening summation volume may be defined for each of the remaining cooling circuits 230B-230J. Preferably, for each of the remaining cooling circuits 230B-230J, a ratio of a volume of the corresponding second diffusion region for that cooling circuit relative to the second metering opening summation volume for that cooling circuit is preferably greater than about 20:1.

Because of the shape of the second and third metering openings 240, 340, 440, 260, 360 and 460, i.e., each defining a ratio of length to first and second dimensions; the ratio of the volume of a corresponding second diffusion region for each cooling circuit relative to a corresponding second metering opening summation volume for the cooling circuit; the in-line position of the ribs 408, 508 and 608 relative to the second metering openings 240, 340 and 440; and the shape and size of the first, second, third and fourth diffusion regions 220, 250, 350, 450, 270, 370, 470, 280, 380 and 480, it is believed that a greater pressure drop may occur within the cooling system 400 of the present invention as compared to many cooling systems provided in prior airfoils. Hence, cooling air may be provided to the inner cavity 212 under an increased pressure, yet leave the cooling circuit exit openings 404, 504, 604 at a sufficiently low pressure so as to form a film of cooling air along corresponding downstream portions 130A-130C of the outer surface 130 of the main body 120. A larger pressure drop within the cooling system 400 corresponds to enhanced internal convective cooling potential within the wall structure 210.

It is noted that each of the first metering openings 222 corresponding to the one or more cooling circuits 230J provided in the trailing edge 114 of the main body 120 has a longitudinal axis $A_{LF}$ generally parallel with a longitudinal axis $A_{LS}$ of each of the second metering openings of the cooling circuits 230J, see FIG. 2.

While a particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An airfoil for a turbine of a gas turbine engine comprising:

a main body comprising a wall structure defining an inner cavity adapted to receive cooling air, said wall structure including a plurality of first diffusion regions, at least one first metering opening extending from said inner cavity to each of said first diffusion regions so as to deliver cooling air from said inner cavity into each said first diffusion region, said wall structure further comprising at least one cooling circuit associated with each said first diffusion region, said cooling circuits each comprising:

a second diffusion region; and at least one second metering opening extending from said respective first diffusion region to said second diffusion region so as to deliver cooling air from said respective first diffusion region into said second diffusion region, said at least one second metering opening including a length in a flow direction and first and second dimensions transverse to one another and to said length such that a first ratio of said length to said first dimension is equal to or greater than about 1.5:1 and a second ratio of said length to said second dimension is equal to or greater than about 1.5:1.

2. The airfoil as set out in claim 1, wherein said first and second dimensions of said at least one second metering opening of each said cooling circuit are defined by a diameter of said at least one second metering opening.

3. The airfoil of claim 1, wherein each said cooling circuit further comprises at least one third metering opening and at least one third diffusion region, said at least one third metering opening extending from a respective one of said second diffusion regions to said at least one third diffusion region so as to deliver cooling air from said respective second diffusion region into said at least one third diffusion region.

4. The airfoil of claim 3, wherein said at least one third metering opening of each said cooling circuit having a length in a flow direction and first and second dimensions transverse to one another and to said length such that a first ratio of said length of said at least one third metering opening to said first dimension of said at least one third metering opening is equal to or greater than about 1.5:1 and a second ratio of said length of said at least one third metering opening to said second dimension of said at least one third metering opening is equal to or greater than about 1.5:1.

5. The airfoil of claim 3, wherein said at least one third diffusion region of each said cooling circuit comprises a plurality of third diffusion regions and said at least one third metering opening comprises a plurality of third metering openings, each of said plurality of third metering openings extending from said respective second diffusion region to a corresponding one of said plurality of third diffusion regions.

6. The airfoil of claim 5, wherein said wall structure comprises inner and outer wall sections, first, second and third intermediate wall sections extending between said inner and outer wall sections, and a plurality of ribs extending between said inner and outer wall sections, said plurality of third metering openings and said plurality of third diffusion regions of each said cooling circuit being defined by corresponding portions of said inner and outer wall sections, corresponding portions of said first and third intermediate wall sections and said plurality of ribs.

7. The airfoil of claim 6, wherein said at least one second metering opening of each said cooling circuit comprises a plurality of second metering openings, and each of said plurality of ribs being substantially in-line with a corresponding one of said second metering openings such that cooling air exiting each of said plurality of second metering openings impinges upon a corresponding one of said ribs.

8. The airfoil of claim 7, wherein each said second diffusion region is defined by corresponding portions of said inner and outer wall sections and corresponding portions of said first, second and third intermediate wall sections, and a summation of a volume of each of said plurality of second metering openings define a second metering opening summation volume and a ratio of a volume of said second diffusion region relative to the second metering opening summation volume is greater than about 20:1.

9. The airfoil of claim 5, wherein at least one of said cooling circuits further comprises a fourth diffusion region communicating with each of said plurality of third diffusion regions and terminating at an exit opening defined by curvilinear wall portions of said wall structure, said exit opening having an area equal to or greater than about 10 times an area of said third metering openings.

10. The airfoil of claim 1, wherein at least one of said cooling circuits is located in a trailing edge of said main body such that a longitudinal axis of said at least one first metering opening is generally parallel with a longitudinal axis of said at least one second metering opening.

11. A vane for a turbine of a gas turbine engine comprising:

first and second endwalls; and an airfoil comprising a main body located between said first and second endwalls, said main body including a wall structure having a first end adjacent said first endwall and a second end adjacent said second endwall, said wall structure defining an inner cavity adapted to receive cooling air and comprising a plurality of first diffusion regions extending from said first end of said wall structure to said second end of said wall structure and at least one first metering opening extending from said inner cavity to each of said first diffusion regions so as to deliver cooling air from said inner cavity into each said first diffusion region, said wall structure further comprising first and second cooling circuits associated with each said first diffusion region, each of said first and second cooling circuits comprising:

a second diffusion region; and at least one second metering opening extending from said respective first diffusion region to said second diffusion region so as to deliver cooling air from said respective first diffusion region to said second diffusion region.

12. The vane of claim 11, wherein said at least one second metering opening in each of said first and second cooling circuits includes a length in a flow direction and first and second dimensions transverse to one another and to said length such that a first ratio of said length to said first dimension is equal to or greater than about 1.5:1 and a second ratio of said length to said second dimension is equal to or greater than about 1.5:1.

13. The vane of claim 11, wherein each of said first and second cooling circuits further comprises at least one third metering opening and at least one third diffusion region.

14. The vane of claim 13, wherein said at least one third diffusion region in each of said first and second cooling circuits comprises a plurality of third diffusion regions.

15. The vane of claim 14, wherein said at least one third metering opening in each of said first and second cooling circuits comprises a plurality of third metering openings, each of said third metering openings of each said first cooling circuit extending from said second diffusion region of said respective first cooling circuit to a corresponding one of said third diffusion regions of said first cooling circuit so as to deliver cooling air from said second diffusion region of said respective first cooling circuit into said third diffusion regions of said respective first cooling circuit and each of said third metering openings of each said second cooling circuit extending from said second diffusion region of said respective second cooling circuit to a corresponding one of said third diffusion regions of said second cooling circuit so as to deliver cooling air from said second diffusion region of said respective second cooling circuit into said third diffusion regions of said respective second cooling circuit.

16. The vane of claim 15, wherein said wall structure comprises first, second and third intermediate wall sections, a plurality of first ribs, and inner and outer wall sections, said plurality of third diffusion regions of each said first cooling circuit being defined by corresponding portions of said inner and outer wall sections, corresponding portions of said first and third intermediate wall sections and said plurality of first ribs.

17. The vane of claim 16, wherein said at least one second metering opening in each said first cooling circuit comprises a plurality of second metering openings, and each of said plurality of first ribs in each said first cooling circuit being substantially in-line with a corresponding one of said second metering openings in said corresponding first cooling circuit such that cooling air exiting each of said plurality of second metering openings in said corresponding first cooling circuit impinges upon a corresponding one of said first ribs in said corresponding first cooling circuit.

18. The vane of claim 14, wherein at least one of said first cooling circuits further comprises a fourth diffusion region communicating with each of said plurality of third diffusion regions of said corresponding first cooling circuit and a first exit opening defined by corresponding curvilinear wall portions of said wall structure and at least one of said second cooling circuits further comprises a fourth diffusion region communicating with each of said plurality of third diffusion regions of said corresponding second cooling circuit and a second exit opening defined by corresponding curvilinear wall portions of said wall structure.

19. The vane of claim 18, wherein at least one of said first cooling circuits is located in a trailing edge of said main body such that a longitudinal axis of said corresponding at least one first metering opening is generally parallel with a longitudinal axis of said at least one second metering opening of said corresponding first cooling circuit.

* * * * *